US009033337B2

(12) United States Patent
Miyake

(10) Patent No.: US 9,033,337 B2
(45) Date of Patent: May 19, 2015

(54) IMAGE FORMING APPARATUS

(71) Applicant: KYOCERA Document Solutions Inc., Osaka (JP)

(72) Inventor: Yasuhiro Miyake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/466,583

(22) Filed: Aug. 22, 2014

(65) Prior Publication Data

US 2015/0054213 A1 Feb. 26, 2015

(30) Foreign Application Priority Data

Aug. 26, 2013 (JP) ..... 2013-174746

(51) Int. Cl.

| | |
|---|---|
| ***B65H 1/00*** | (2006.01) |
| ***B65H 3/34*** | (2006.01) |
| ***B65H 1/04*** | (2006.01) |
| ***B65H 1/08*** | (2006.01) |
| ***B65H 3/06*** | (2006.01) |

(52) U.S. Cl.

CPC .. *B65H 3/34* (2013.01); *B65H 1/04* (2013.01); *B65H 1/08* (2013.01); *B65H 3/0661* (2013.01); *B65H 3/0684* (2013.01)

(58) Field of Classification Search

CPC ..... B65H 2405/11172; B65H 2405/3231; B65H 1/027; B65H 2405/1134; B65H 2405/31

USPC ..... 271/162, 145, 157, 264, 147, 9.09, 121

See application file for complete search history.

(56) References Cited

U.S. PATENT DOCUMENTS

2002/0063374 A1* 5/2002 Takahashi ..... 271/10.01
2011/0001284 A1* 1/2011 Ohtsuki ..... 271/162

FOREIGN PATENT DOCUMENTS

JP 2-13542 * 1/1990
JP 2007-106573 A 4/2007

* cited by examiner

*Primary Examiner* — Thomas Morrison
(74) *Attorney, Agent, or Firm* — Stein IP, LLC

(57) ABSTRACT

A manual paper-sheet feed portion of an image forming apparatus includes a manual tray, a feed opening, a feed roller, and a shutter. The manual tray is shifted to an opened state, whereby placement of a recording medium becomes possible. The feed opening accepts feeding of the recording medium to a conveyance path. The feed roller feeds the recording medium to the conveyance path. When the feeding of the recording medium to the conveyance path is started, the shutter swings in one direction to open the feed opening, and when a rear end of the recording medium passes through the feed opening, the shutter swings in the other direction to return to a position where to shield the feed opening.

6 Claims, 8 Drawing Sheets

IMAGE FORMING APPARATUS

INCORPORATION BY REFERENCE

The present application is based on Japanese Patent Application No. 2013-174746 filed on Aug. 26, 2013, the contents of which are hereby incorporated by reference.

BACKGROUND OF THE INVENTION

The present disclosure relates to an image forming apparatus that comprises a manual tray mounted on an apparatus main body in an openable and closable manner.

Some image forming apparatuses allow manual paper-sheet feeding. In such image forming apparatuses, a manual tray for manual paper-sheet feeding is mounted on an apparatus main body in an openable and closable manner. And, it is impossible to perform the manual paper-sheet feeding when the manual tray is in the closed state, and by bringing the manual tray to the opened state, the manual paper-sheet feeding becomes possible.

The image forming apparatus, which allows the manual paper-sheet feeding, is additionally provided with a manual conveyance path for the manual paper-sheet feeding. One end of the manual conveyance path connects with an image forming portion that performs forming of a toner image and transferring of the toner image to a paper sheet. The other end of the manual conveyance path connects with the manual tray and is used as a paper-sheet feeding opening that accepts feeding of a papers sheet from the manual tray to the manual conveyance path. And, the paper-sheet feeding opening is closed by the manual tray when the manual tray is in the closed state, while the paper-sheet feeding opening is exposed when the manual tray is shifted to the opened state.

SUMMARY OF THE INVENTION

An image forming apparatus according to the present disclosure includes a manual paper-sheet feed portion. The manual paper-sheet feed portion is disposed on a side surface of an apparatus main body and feeds a recording medium to a conveyance path of the apparatus main body. The manual paper-sheet feed portion includes a manual tray, a feed opening, a feed roller, and a shutter. The manual tray is mounted on the apparatus main body in an openable and closable manner, and allows, in the opened state, to load the recording medium thereon. The feed opening is exposed in the opened state of the manual tray and accepts the feeding of the recording medium from the manual tray to the conveyance path. The feed roller is disposed at the feed opening, comes into contact with the recording medium from above the recording medium placed on the manual tray, rotates in one direction in the contact state with the recording medium and thereby feeds the recording medium to the conveyance path via the feed opening. The shutter is disposed so as to shield the feed opening. And, the shutter is disposed on both sides in a shaft direction of a rotary shaft of the feed roller, one end portion of the shutter is disposed above the manual tray, the shutter is rotatably supported along a feed direction with the one end portion used as a pivot; at a shielding position to shield the feed opening, when the feeding of the recording medium to the conveyance path is started by the feed roller, the shutter swings toward a downstream side in the feed direction to open the feed opening; when an upstream-side end portion, in the feed direction, of the recording medium passes through the feed opening, the shutter swings toward the upstream side in the feed direction to return to the shielding position.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS (Whole Structure of Image Forming Apparatus)

Figure 1:
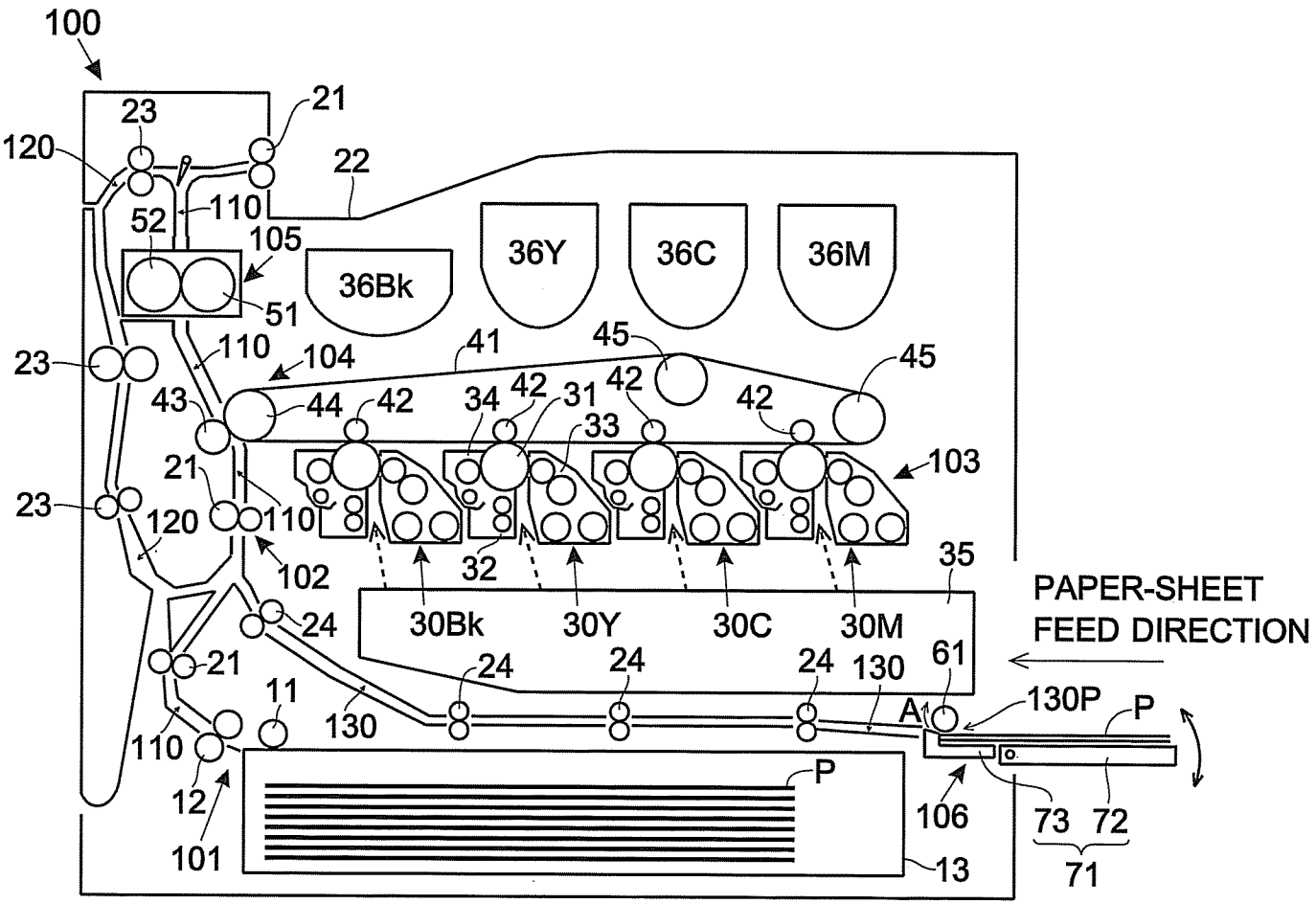
FIG. 1 is a schematic view of an image forming apparatus according to an embodiment of the present disclosure.

As shown in FIG. 1, an image forming apparatus 100 according to the present embodiment is a color laser printer of tandem type and forms a toner image based on image data received from external apparatuses such as a personal computer and the like. And, the image forming apparatus 100 carries a paper sheet P, transfers the toner image to the paper sheet P and outputs the paper sheet P.

Specifically, the image forming apparatus 100 comprises: a paper-sheet feed portion 101; a paper-sheet carry portion 102; a toner image forming portion 103; a transfer portion 104; a fixing portion 105; and a manual paper-sheet feed portion 106. Besides, the image forming apparatus 100 comprises, as a conveyance path for carrying the paper sheet P, a main conveyance path 110, a reverse conveyance path 120 and a manual conveyance path 130.

The paper-sheet feed portion 101 includes a pickup roller 11 and a pair of paper-sheet feed rollers 12, and feeds the paper sheet P stored in a paper-sheet cassette 13 to the main conveyance path 110. The paper-sheet carry portion 102 includes a plurality of pairs of carry rollers 21, carries the paper sheet P fed to the main conveyance path 110 in an order of a transfer nip and a fixing nip to eject the paper sheet P to an ejection tray 22.

Besides, the paper-sheet carry portion 102 includes a plurality of pairs of rollers 23 that reversely carry the paper sheet P along the reverse conveyance path 120. Further, the paper-sheet carry portion 102 includes a plurality of pairs of rollers 24 for manual feeding that carry the paper sheet P along the manual conveyance path 130.

The toner image forming portion 103 includes: a photo-sensitive drum 31; an electrification device 32; a development device 33; a drum cleaning device 34; and a light exposure device 35, and forms toner images of respective colors of black, yellow, cyan, and magenta. In the meantime, the toner image forming portion 103 is divided into mechanism portions 30Bk, 30Y, 30C, and 30M that correspond to the respective colors. And, each of the mechanism portions 30Bk, 30Y, 30C, and 30M has one set of the photo-sensitive drum 31, the electrification portion 32, the development device 33, and the drum cleaning device 34, and forms the corresponding-color toner image. In the meantime, the color toners are stored in toner containers 36Bk, 36Y, 36C, and 36M, respectively.

The transfer portion 104 includes an intermediate transfer belt 41, a primary transfer roller 42, and a secondary transfer roller 43, and transfers the toner image formed by the toner image forming portion 103 to the paper sheet P. The intermediate transfer belt 41 is mounted by a drive roller 44 and a driven roller 45. The primary transfer roller 42 is disposed inside the intermediate transfer belt 41 and cooperates with the photo-sensitive drum 31 to sandwich the intermediate transfer belt 41. The secondary transfer roller 43 is disposed to oppose the drive roller 44 via the intermediate transfer belt 41, and cooperates with the intermediate transfer belt 41 to form a transfer nip.

The fixing portion 105 includes a heat roller 51 and a pressurization roller 52, heats and pressurizes the toner image transferred to the paper sheet P to fix the toner image. The heat roller 51 incorporates a heat generation source. The pressurization roller 52 comes into tight contact with the heat roller 51 and cooperates with the heat roller 51 to form a fixing nip.

Here, during an execution period of a one-side printing job, the paper sheet P undergoing the one-side printing is sent from the fixing nip to the ejection tray 22. On the other hand, during an execution period of a both-side printing job, the paper sheet P undergoing the one-side printing is sent from the fixing nip to the reverse conveyance path 120, and returned to an upstream-side position in the paper-sheet feed direction beyond the position of the transfer nip of the main conveyance path 110. And, the paper sheet P undergoing the one-side printing is carried along the main conveyance path 110 and passes again through the transfer nip and the fixing nip. At this time, the paper sheet P is reversed in the front and back; accordingly, the printing is applied to the back surface (not-printed surface) of the paper sheet P.

(Structure of the Manual Paper-Sheet Feed Portion)

Figure 2:
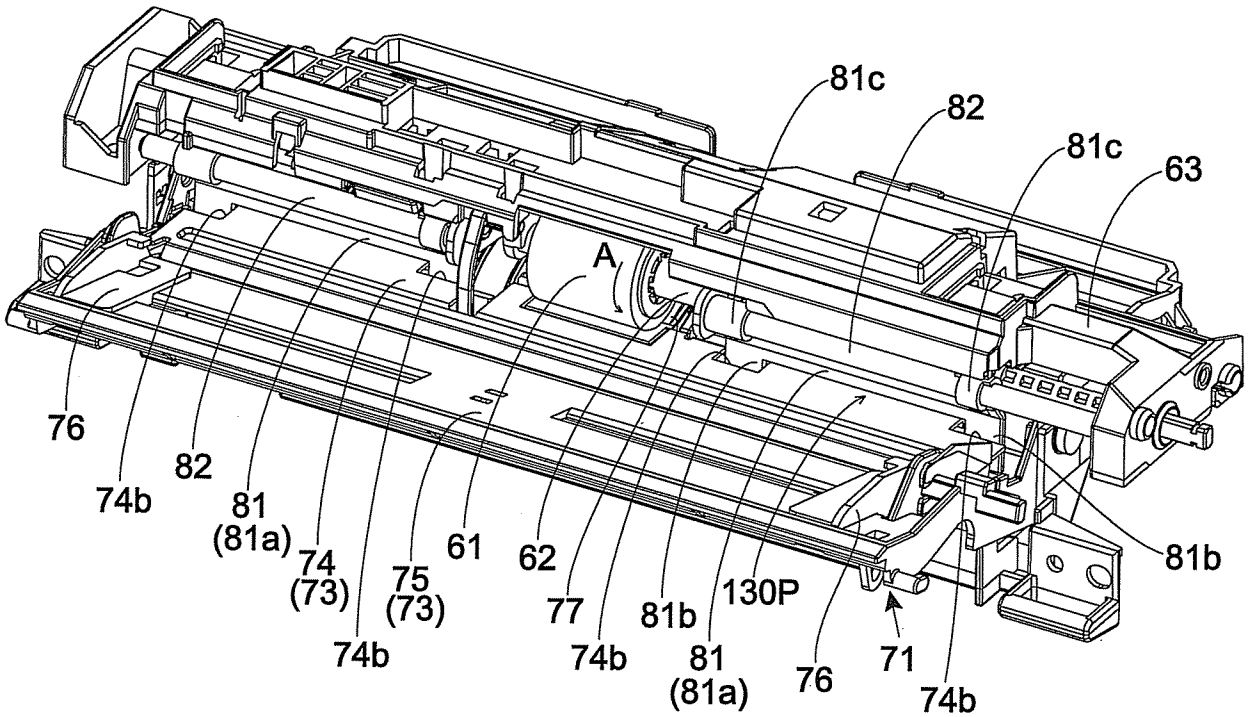
FIG. 2 is a perspective view when seeing, from an upstream side in a paper-sheet feed direction, a peripheral mechanism portion of a manual paper-sheet feeding opening of the image forming apparatus shown in FIG. 1.

As shown in FIG. 1 and FIG. 2, the manual paper-sheet feed portion 106 comprises a paper-sheet feed roller 61 (which corresponds to a "feed roller") and a manual tray 71.

The paper-sheet feed roller 61 is disposed at a paper-sheet feeding opening 130P (which corresponds to a "feed opening") that accepts feeding of the paper sheet P from the manual tray 71 to the manual conveyance path 130, and mounted on a rotary shaft 62 to rotate together with the rotary shaft 62. The rotary shaft 62 is rotatably supported by a frame 63. Besides, although not shown, the rotary shaft 62 is connected to a paper-sheet feeding motor via a gear and the like, and rotated by a drive force conducted from the paper-sheet feeding motor. And, during an execution period of manual paper-sheet feeding, the paper-sheet feed roller 61 comes into contact with the paper sheet P placed on the manual tray 71 from above the paper sheet P, the rotary shaft 62 rotates in an A direction (one direction) in the contact state with the paper sheet P, and also the paper-sheet feed roller 61 rotates in the A direction together with the rotary shaft 62. In this way, the paper sheet P placed on the manual tray 71 is sent in a paper-sheet feed direction (feed direction) by the paper-sheet feed roller 61 and fed to the manual conveyance path 130 via the paper-sheet feeding opening 130P.

The manual tray 71 includes a cover portion 72 and a paper-sheet guide portion 73. The cover portion 72 is mounted on the apparatus main body in an openable and closable manner (rotatably). And, although not shown, the cover portion 72 is closed along a side surface of the apparatus main body in the closed state. In the meantime, during this period, it is impossible to place the paper sheet P onto the manual tray 71.

When the cover portion 72 is shifted from the closed state to the opened state (state in FIG. 1), the paper-sheet guide portion 73 is exposed. A paper-sheet placement surface of the manual tray 71 is formed by the cover portion 72 and the paper-sheet guide portion 73 when the cover portion 72 is shifted to the opened state. In other words, by shifting the cover portion 72 to the opened state, the paper-sheet placement surface of the manual tray 71 is exposed, so that it becomes possible to place the paper sheet P onto the manual tray 71. Besides, when the cover portion 72 is shifted to the opened state, also the paper-sheet feeding opening 130P is exposed.

Figure 3:
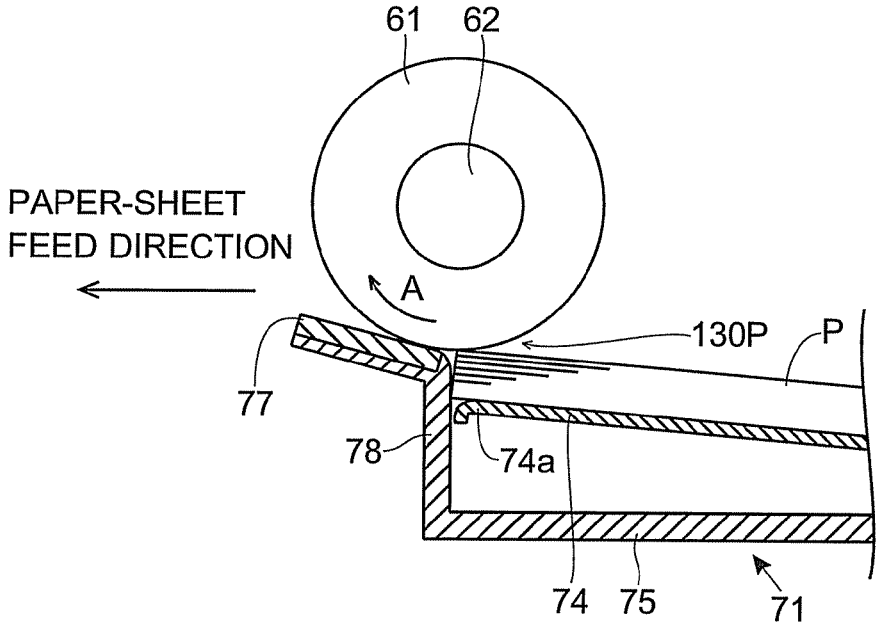
FIG. 3 is a schematic view (view of a state where a paper-sheet feed roller and a paper sheet are in contact with each other) for describing structures of the paper-sheet feed roller and manual tray of the image forming apparatus shown in FIG. 1.
Figure 4:
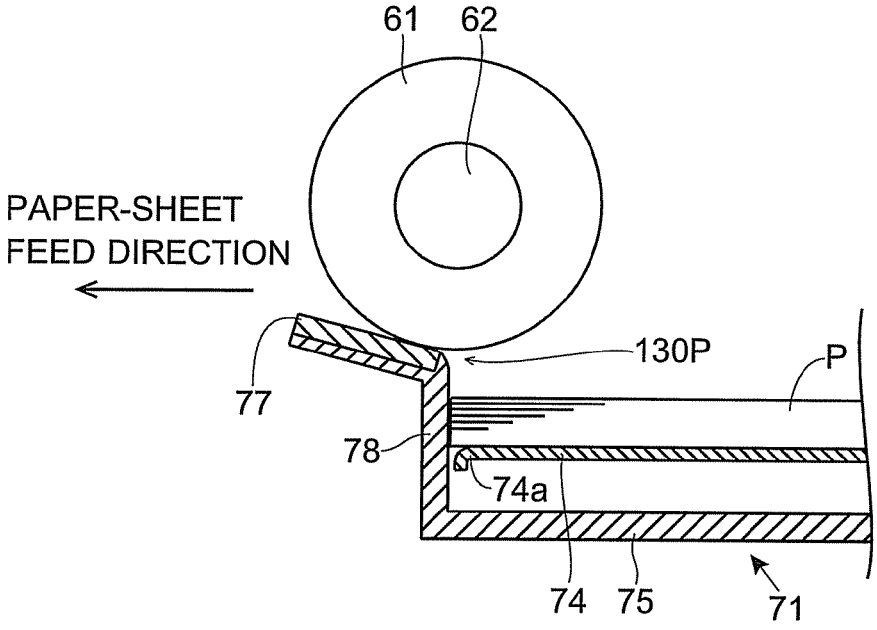
FIG. 4 is a schematic view (view of a state where the paper-sheet feed roller and the paper sheet are not in contact with each other) for describing structures of the paper-sheet feed roller and manual tray of the image forming apparatus shown in FIG. 1.

As shown in FIG. 2 to FIG. 4, the paper-sheet guide portion 73 has a lift plate 74 and a base 75 that form the paper-sheet placement surface of the manual tray 71. The lift plate 74 is disposed near the paper-sheet feeding opening 130P, and supported by the base 75 to ascend and descend with an upstream-side portion in the paper-sheet feed direction used as a pivot. And, the lift plate 74 ascends and thereby lifts a downstream-side portion (portion near the paper-sheet feeding opening 130P), in the paper-sheet feed direction, of the paper sheet P placed on the manual tray 71 to make the paper sheet P come into contact with the paper-sheet feed roller 61.

Specifically, the lift plate 71 has an end portion 74*a* near the paper-sheet feeding opening 130P as a rotary end, and rotates to move the end portion 74*a* as the rotary end in an up-down direction. In this structure, the end portion 74*a* of the lift plate 74 ascends and descends. When the end portion 74*a* of the lift plate 74 ascends (rotates in the upward direction), the end portion 74*a* of the lift plate 74 approaches the paper-sheet feed roller 61 (see FIG. 3). In this way, a tip end portion of the paper sheet P placed on the manual tray 71 comes into contact with the paper-sheet feed roller 61; accordingly, the paper-sheet feeding by the paper-sheet feed roller 61 to the paper-sheet conveyance path 130 becomes possible. Besides, when the end portion 74*a* of the lift plate 74 descends (rotates in the downward direction), the end portion 74*a* of the lift plate 74 goes away from the paper-sheet feed roller 61 (see FIG. 4). In this way, it becomes possible to place the paper sheet P onto the manual tray 71. In the meantime, FIG. 4 shows a state where the end portion 74*a* of the lift plate 74 descends to a predetermined descent limit position (lowest point).

For example, although not shown, a rear surface opposite to the paper-sheet placement surface of the lift plate 74 is provided thereon with a pushing member such as a coil spring or the like that pushes the lift plate 74 in the upward direction. And, before the execution of the manual paper-sheet feeding, the lift plate 74 is pushed downward countering the upward pushing force of the pushing member to make the end portion 74*a* of the lift plate 74 descend to the descent limit position. In other words, as shown in FIG. 4, the state is obtained, where it is possible to place the paper sheet P onto the manual tray 71.

On the other hand, during the execution period of the manual paper-sheet feeding, the downward pushing of the lift plate 74 is released, and the end portion 74*a* of the lift plate 74 is made to ascend by means of the upward pushing force of the pushing member. In other words, as shown in FIG. 3, the tip end portion of the paper sheet P placed on the manual tray 71 is pushed against the paper-sheet feed roller 61 to obtain the state where it is possible to perform the paper-sheet feeding to the manual conveyance path 130 by means of the paper-sheet feed roller 61.

In the meantime, as a pushing member for pushing the lift plate 74 downward, for example, an eccentric cam, which is rotated by a drive force conducted from the paper-sheet feeding motor (motor that rotates the paper-sheet feed roller 61), is used. In this case, the lift plate 74 is provided with a cam follower that comes into contact with the eccentric cam. In this way, it is possible to make the lift plate 74 ascend and descend in accordance with the rotation of the eccentric cam. Or, a motor for making the lift plate 74 ascend and descend may be disposed independent of the paper-sheet feeding motor.

The base 75 is provided with a pair of width adjustment cursors 76 that perform positioning of the paper sheet P in a width direction (direction perpendicular to the paper-sheet feed direction). The pair of width adjustment cursors 76 are disposed in the upstream side in the paper-sheet feed direction with respect to the lift plate 74, and mounted slidably in the width direction of the paper sheet P. Besides, the base 75 is provided with a separation pad 77 that alleviates double carrying of the paper sheet P. The separation pad 77 comes into tight contact with the paper-sheet feed roller 61 in the upstream side in the paper-sheet feed direction with respect to the lift plate 74 and thereby cooperates with the paper-sheet feed roller 61 to form a separation nip.

Further, the base 75 is provided with a stopper 78 (which corresponds to a "wall portion") that performs positioning of the tip end (downstream-side end portion in the paper-sheet feed direction) of the paper sheet P placed on the manual tray 71. The stopper 78 is disposed in the downstream side in the paper-sheet feed direction with respect to the lift plate 74 and formed into a wall shape to rise in the upward direction. And, the tip end of the paper sheet P placed on the manual tray 71 comes into contact with the stopper 78, whereby the tip end of the paper sheet P is positioned. In the meantime, the paper-sheet feeding opening 130P is formed above the stopper 78.

(Structure of a Shutter Disposed at the Paper-Sheet Feeding Opening)

Figure 5:
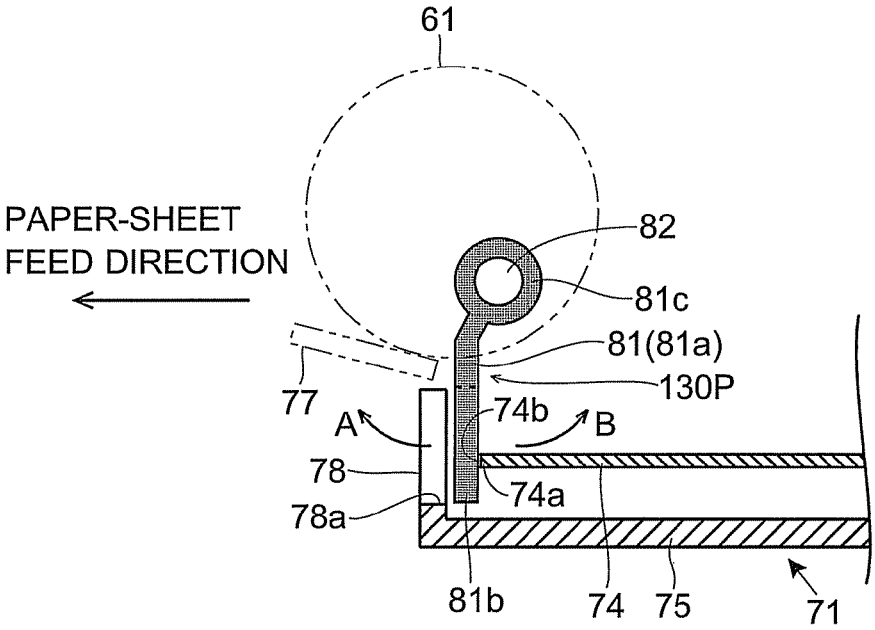
FIG. 5 is a schematic view for describing a structure of a shutter of the image forming apparatus shown in FIG. 1.

As shown in FIG. 2 and FIG. 5, a shutter 81, which is disposed to shield the paper-sheet feeding opening 130P, is disposed at the paper-sheet feeding opening 130P of the paper-sheet conveyance path 130. The shutter 81 is supported rotatably in an A direction (direction that goes to the downstream side in the paper-sheet feed direction) and a B direction (direction that goes to the upstream side in the paper-sheet feed direction) about a pivot that is located at a position higher than the contact position where the tip end portion of the paper sheet P placed on the manual tray 71 and the paper-sheet feed roller 61 come into contact with each other. In the meantime, the shutter 81 is disposed from both ends in a shaft direction (direction perpendicular to the paper-sheet feed direction of the paper-sheet feed roller 61) of the rotary shaft of the paper-sheet feed roller 61 to side walls of the frame 63. In other words, the shutter 81 is disposed on both sides in the shaft direction of the rotary shaft of the paper-sheet feed roller 61.

Figure 6:
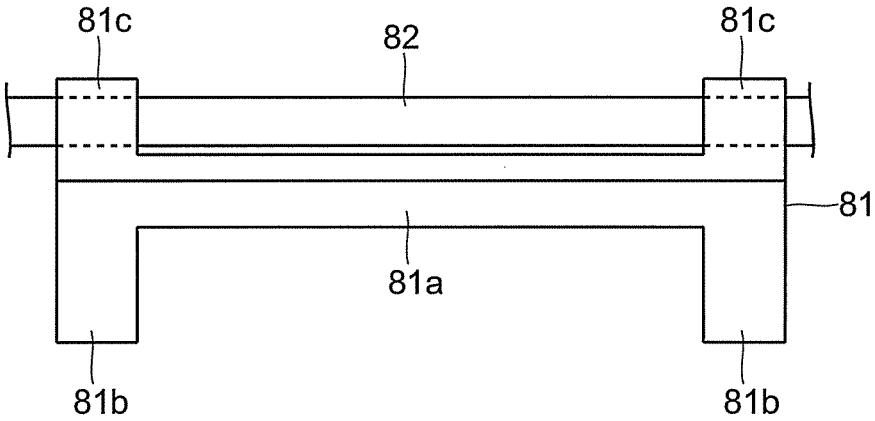
FIG. 6 is a plan view when seeing, from the upstream side in the paper-sheet feed direction, the shutter of the image forming apparatus shown in FIG. 1.

The shutter 81 is a plate-like member that has a C shape, and has: a shielding portion 81*a* that extends in the width direction; contact portions 81*b* that extend downward from both ends of the shielding portion 81*a*; and fit-in portions 81*c* that extend upward from both ends of the shielding portion 81*a* (see FIG. 6).

The shielding portion 81*a* of the shutter 81 is a portion that actually shields the paper-sheet feeding opening 130P, and is disposed above the end portion 74*a* of the lift plate 74. And, the shielding 81*a* of the shutter 81 shields (disposed at a shielding position to shield the paper-sheet feeding opening 130P) a gap of the paper-sheet feeding opening 130P when the lift plate 74 ascends. In other words, if the paper sheets P are placed on the lift plate 74, the shielding portion 81*a* shields a gap between the uppermost paper sheet P and an upper portion of the paper-sheet feeding opening 130P, while if the paper sheets P are not placed on the lift plate 74, the shielding portion 81*a* shields a gap between the end portion 74*a* of the lift plate 74 and the upper portion of the paper-sheet feeding opening 130P.

In the meantime, the shielding portion 81*a* of the shutter 81 allows the lift plate 74 to ascend and descend between the lower limit position of the lift plate 74 when the paper sheet P is fed to the manual tray 71 and the contact position where the paper sheet P comes into contact with the paler-sheet feed roller 61.

Here, if a lower end position of the shielding portion 81*a* of the shutter 81 becomes too low because of an assembly error and the like, the lift plate 74 comes into contact with the shielding portion 81*a* of the shutter 81 during the ascent period of the lift 74, so that the contact pressure between the paper sheet P on the lift plate 74 and the paper-sheet feed roller 61. In this case, there is a risk that faulty paper-sheet feeding such as idling of the paper-sheet feed roller 61 and the like occurs. Because of this, the lower end position of the shielding portion 81*a* of the shutter 81 is set at a position (position where a gap occurs between the shielding portion 81*a* of the shutter 81 and the end portion 74*a* of the lift plate 74) where the shielding portion 81*a* of the shutter 81 does not come into contact with the end portion 74*a* of the lift plate 74 when the lift plate 74 ascends to the position to come into contact with the paper-sheet feed roller 61.

The contact portion 81*b* of the shutter 81 extends downward beyond an upper end position of the end portion 74*a* of the lift plate 74 when the lift plate 74 descends to the lower limit position. In this way, when the shutter 81 tries to swing in the B direction from the position for shielding the paper-sheet feeding opening 130P, the contact portion 81*b* of the shutter 81 and the end portion 74*a* of the lift plate 74 come into contact with each other, so that the rotation of the shutter 81 in the B direction is limited. However, the contact portion

81*b* disposed on the shutter 81 becomes an obstacle when the contact portion 81*b* of the shutter 81 makes the lift plate 74 ascend. Accordingly, the end portion 74*a* of the lift plate 74 is provided with a cutout 74*b* (which corresponds to a "first cutout portion") to avoid interference between the lift plate 74 and the contact portion 81*b* of the shutter 81 when the lift plate 74 is moving up and down. And, the rotation of the contact portion 81*b* of the shutter 81 in the B direction is limited by the contact portion 81*b* of the shutter 81 coming into contact with (going into) the cutout 74*b* of the lift plate 74.

The fit-in portion 81*c* of the shutter 81 is a portion into which a swing shaft 82 is fitted. The swing shaft 82 is mounted on the frame 63 and disposed in parallel with the rotary shaft 62 of the paper-sheet feed roller 61 at a position higher than the contact position where the tip end portion of the paper sheet P placed on the manual tray 71 and the paper-sheet feed roller 61 come into contact with each other. In the meantime, the fitting between the fit-in portion 81*c* of the shutter 81 and the swing shaft 82 is gap-fitting. In this way, the shutter 81 is supported rotatably in the A direction and B direction. In other words, the shutter 81 swings in the A direction when pushed in the paper-sheet feed direction, and when the pushing in the paper-sheet feed direction is released, the shutter 81 swings in the B direction to return to the original position (shielding position).

Figure 7:
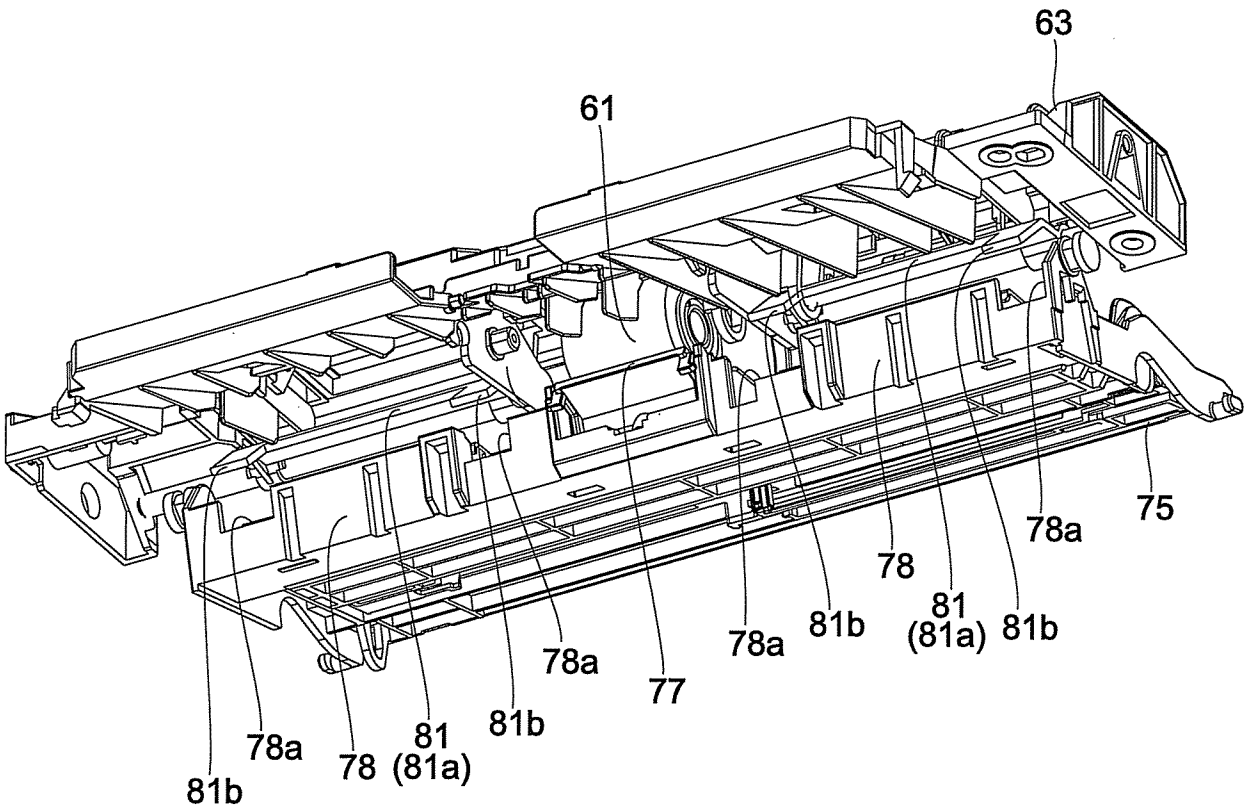
FIG. 7 is a perspective view when seeing, from a downstream side in the paper-sheet feed direction, the peripheral mechanism portion of the manual paper-sheet feeding opening of the image forming apparatus shown in FIG. 1.

In the meantime, the stopper 78 for positioning the tip end of the paper sheet P placed on the manual tray 71 is disposed upright in the downstream side in the paper-sheet feed direction with respect to the contact portion 81*b* of the shutter 81. The stopper 78 is disposed upright at such a position; accordingly, the stopper 78 becomes an obstacle when the shutter 81 is swung in the A direction (it is impossible to open the paper-sheet feeding opening 130P that is shielded by the shutter 81). Accordingly, the stopper 78 is provided with a cutout 78*a* (which corresponds to a "second cutout portion") to avoid interference between the stopper 78 and the contact portion 81*b* of the shutter 81 when the shutter 81 swings in the A direction (see FIG. 7).

Next, with reference to FIG. 5 and FIG. 8 to FIG. 13, behavior of the shutter 81 during the manual paper-sheet feeding period is described. In the meantime, FIG. 10 to FIG. 13 show the paper sheet P fed to the manual conveyance path 130 by means of a bold line.

Figure 8:
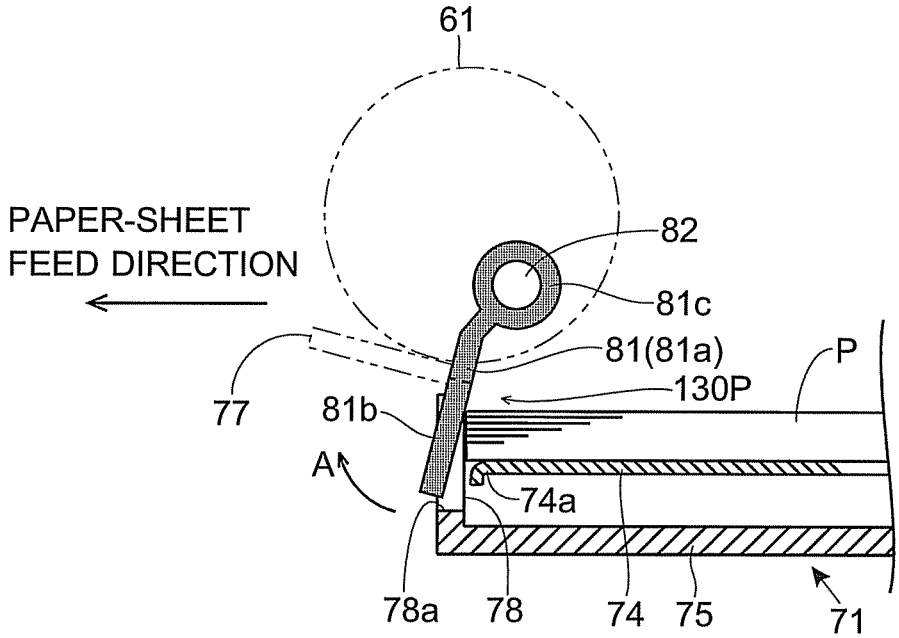
FIG. 8 is a schematic view (view when a paper sheet is placed on the manual tray) for describing behavior of the shutter during a period of manual paper-sheet feeding in the image forming apparatus shown in FIG. 1.

First, as shown in FIG. 5, before the execution of the paper-sheet feeding, the lift plate 74 is located at the lower limit position, and it is possible to place the paper sheet P onto the manual tray 71. And, in this state, as shown in FIG. 8, the paper sheet P is placed onto the manual tray 71. In the meantime, the paper sheet P placed on the manual tray 71 is pushed in the paper-sheet feed direction such that the tip end of the paper sheet P comes into contact with the stopper 78. Accordingly, the contact portion 81*b* of the shutter 81 is pushed against the tip end of the paper sheet P and the shutter 81 swings in the A direction. During this period, part of the shutter 81 moves to the downstream side in the paper-sheet feed direction beyond the disposition position of the stopper 78.

Figure 9:
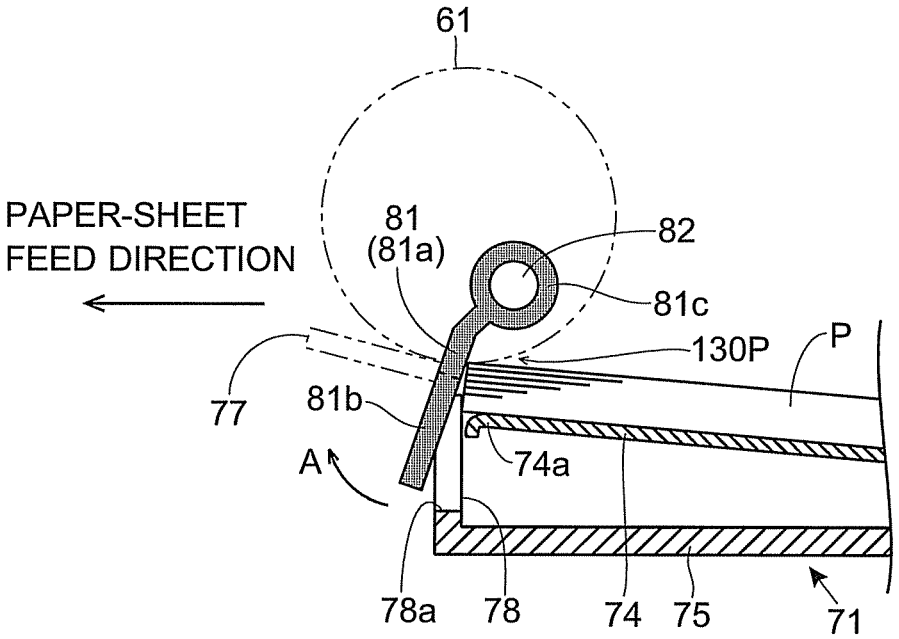
FIG. 9 is a schematic view (view when a lift plate ascends and a paper sheet comes into contact with the paper-sheet feed roller) for describing behavior of the shutter during a period of manual paper-sheet feeding in the image forming apparatus shown in FIG. 1.
Figure 10:
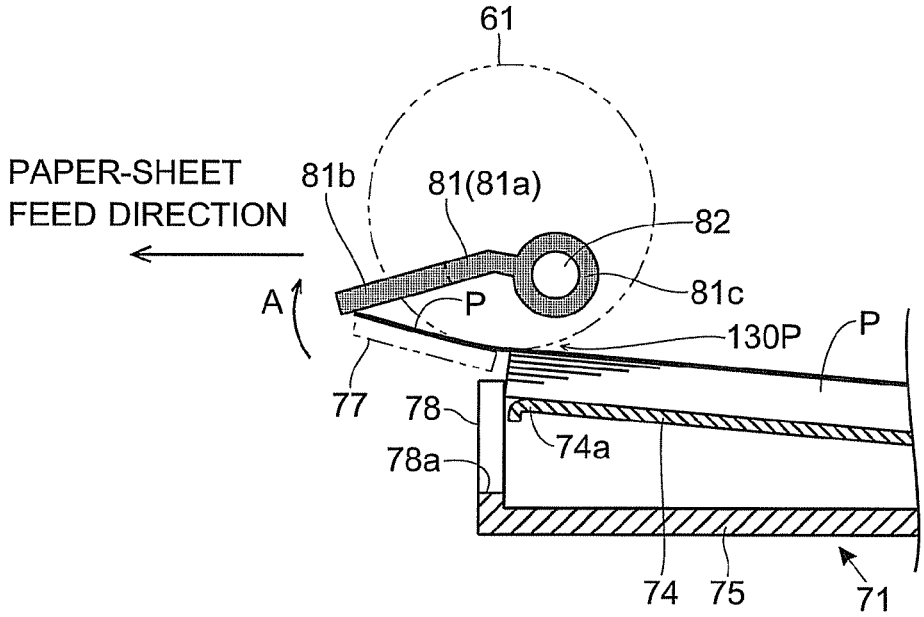
FIG. 10 is a schematic view (view when the shutter is pushed by a tip end of a paper sheet to swing in one direction) for describing behavior of the shutter during a period of manual paper-sheet feeding in the image forming apparatus shown in FIG. 1.

Thereafter, as shown in FIG. 9, the end portion 74*a* of the lift plate 74 ascends, and the paper sheet P placed on the manual tray 71 and the paper-sheet feed roller 61 come into contact with each other. Besides, the paper-sheet feed roller 61 rotates in the A direction and the paper sheet P is sent in the paper-sheet feed direction. When the paper sheet P is sent in the paper-sheet feed direction, as shown in FIG. 10, the tip end of the paper sheet P pushes the shutter 81 in the paper-sheet feed direction. Accordingly, the shutter 81 swings in the A direction and the paper-sheet feeding opening 130P is opened.

Figure 11:
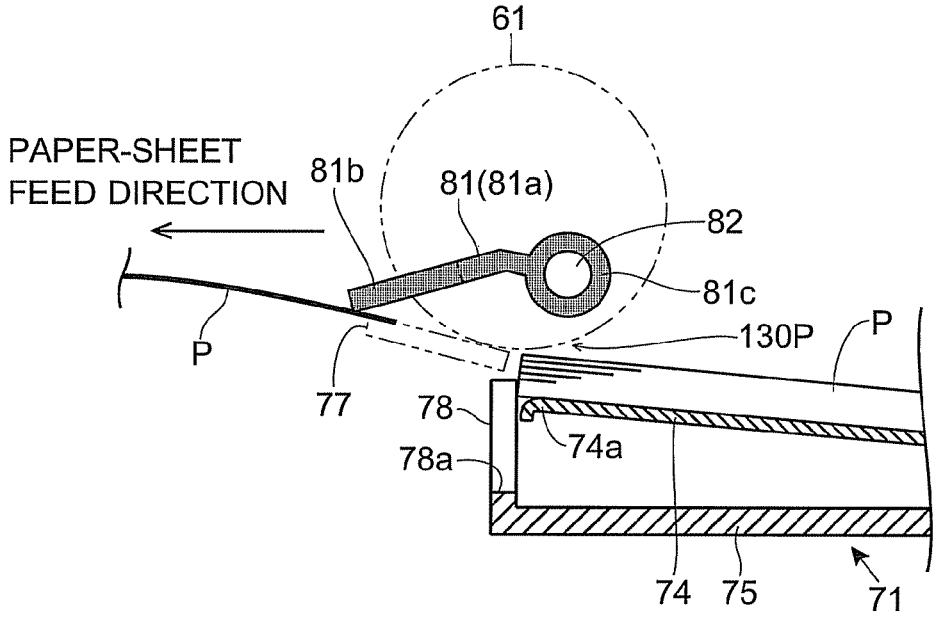
FIG. 11 is a schematic view (view immediately before a rear end of a paper sheet comes out of a rotary range of the shutter) for describing behavior of the shutter during a period of manual paper-sheet feeding in the image forming apparatus shown in FIG. 1.
Figure 12:
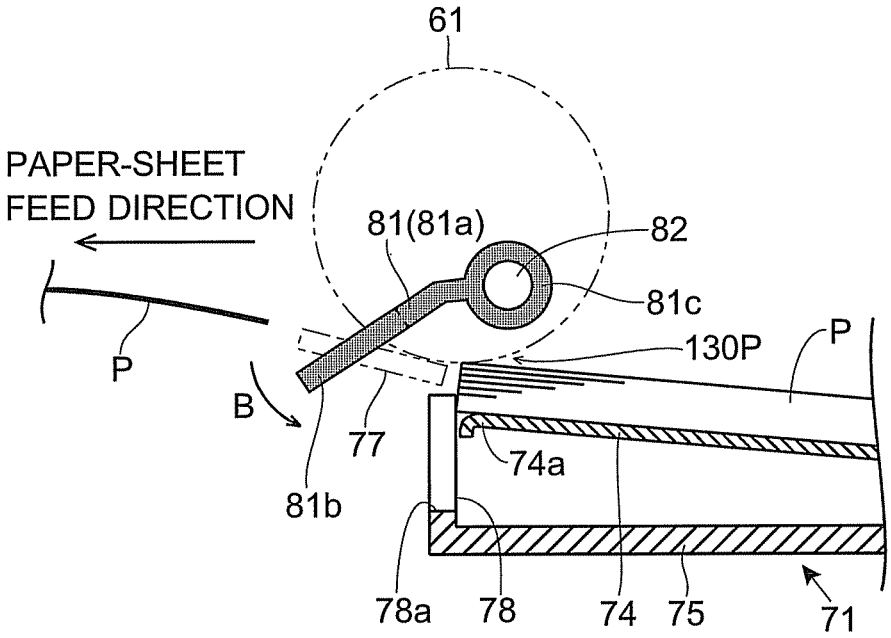
FIG. 12 is a schematic view (view when a rear end of a paper sheet comes out of a rotary range of the shutter) for describing behavior of the shutter during a period of manual paper-sheet feeding in the image forming apparatus shown in FIG. 1.
Figure 13:
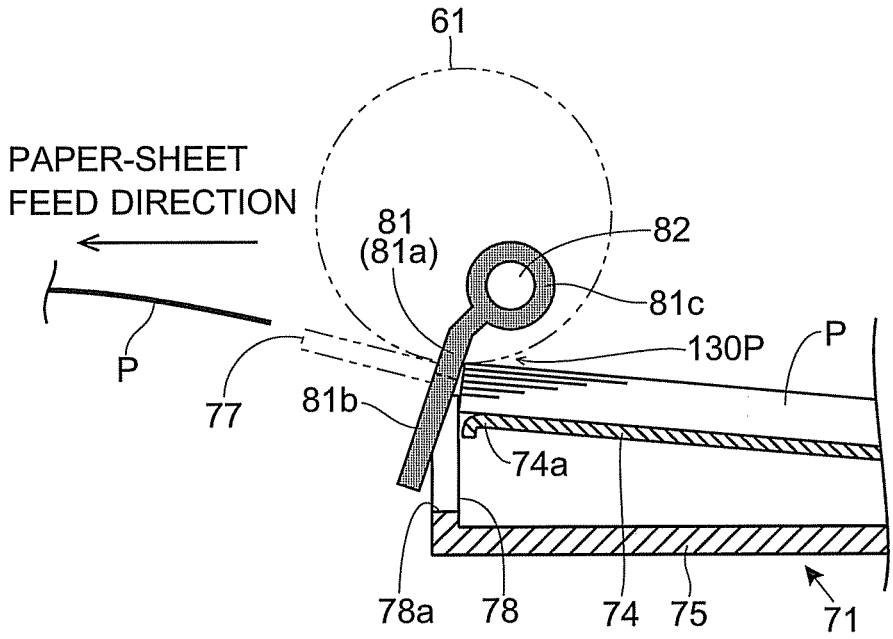
FIG. 13 is a schematic view (view when the shutter swings in the other direction to return to the original position) for describing behavior of the shutter during a period of manual paper-sheet feeding in the image forming apparatus shown in FIG. 1.

In this way, as shown in FIG. 11, the paper sheet P is fed to the manual conveyance path 130 via the paper-sheet feeding opening 130P. And, with the shutter 81 located on the paper sheet P, the paper sheet P advances in the paper-sheet feed direction. Then, as shown in FIG. 12, when a rear end (upstream-side end portion in the paper-sheet feed direction) of the paper sheet P passes through the paper-sheet feeding opening 130P and comes out of the rotary route of the shutter 81, the shutter 81 swings in the B direction by means of its weight. Consequently, as shown in FIG. 13, the shutter 81 returns to the position (returns to the shielding position) to shield the paper-sheet feeding opening 130P.

As described above, the image forming apparatus 100 according to the present embodiment is the image forming apparatus 100 that comprises the manual paper-sheet feed portion 106 which is disposed on the side surface of the apparatus main body and feeds the paper sheet P (recording medium) placed manually to the manual conveyance path 130 (conveyance path), the manual paper-sheet feed portion 106 includes: the manual tray 71 that is mounted on the apparatus main body in an openable and closable manner and allows, in the opened state, to load the paper sheet P; the paper-sheet feeding opening 130P (feed opening) that is exposed in the opened state of the manual tray 71 to accept the feeding of the paper sheet P from the manual tray 71 to the manual conveyance path 130; the paper-sheet feed roller 61 (feed roller) that is disposed at the paper-sheet feeding opening 130P, comes into contact with the paper sheet P placed on the manual tray 71 from above the paper sheet P, rotates in the A direction (one direction) in the contact state with the paper sheet P and thereby feeds the paper sheet P to the manual conveyance path 130 via the paper-sheet feeding opening 130P; and the shutter 81 that is disposed at the paper-sheet feeding opening 130P so as to shield the paper-sheet feeding opening 130P. And, the shutter 81 is disposed on both sides in the shaft direction of the rotary shaft of the paper-sheet feed roller 61, one end portion of the shutter is disposed above the manual tray 71, the shutter is supported rotatably in the A direction and the B direction with the one end portion used as a pivot; at the shielding position so as to shield the paper-sheet feeding opening 130P, when the paper-sheet feeding to the manual conveyance path 130 is started by the paper-sheet feed roller 61, the shutter swings in the A direction to open the paper-sheet feeding opening 130P; when the rear end of the paper sheet P passes through the paper-sheet feeding opening 130P, the shutter swings in the B direction to return to the position (shielding position) so as to shield the paper-sheet feeding opening 130P.

In the structure of the present embodiment, the shutter 81 is disposed so as to shield the paper-sheet feeding opening 130P of the manual conveyance path 130 for carrying the paper sheet P placed on the manual tray 71. In this way, even if a job is executed with the manual tray 71 kept in the opened state (with the paper-sheet feeding opening 130P exposed), it is possible to alleviate an operation sound, which occurs in the apparatus, leaking from the paper-sheet feeding opening 130P to outside of the apparatus. In other words, it is possible to alleviate a noise level during the job execution period becoming high.

In the meantime, the shutter 81 disposed so as to shield the paper-sheet feeding opening 130P is supported rotatably in the A direction and the B direction with the position, which is higher than the contact position where the paper-sheet feed roller 61 and the paper sheet P come into contact with each other, used as the pivot. And, when the paper-sheet feeding to the manual conveyance path 130 is started by the paper-sheet feed roller 61, the shutter swings in the A direction to open the paper-sheet feeding opening 130P; when the rear end of the paper sheet P passes through the paper-sheet feeding opening 130P, the shutter swings in the B direction to return to the position so as to shield the paper-sheet feeding opening 130P. Accordingly, even if the shutter 81 is disposed so as to shield the paper-sheet feeding opening 130P, the feeding of the paper sheet P from the manual tray 71 to the manual conveyance path 130 is not discouraged by the shutter 81.

Besides, in the present embodiment, as described above, at the shielding position, the shutter 81 is disposed to oppose the tip end of the paper sheet P; when the paper-sheet feeding to the paper-sheet conveyance path 130 is started by the paper-sheet feed roller 61, the shutter comes into contact with the tip end of the paper sheet P to be pushed and thereby swings in the A direction to open the paper-sheet feeding opening 130P; when the contact between the shutter 81 and the rear end of the paper sheet P passing through the paper-sheet feeding opening 130P is released, the shutter swings, by means of its weight, in the B direction to return to the position so as to shield the paper-sheet feeding opening 130P. According to this structure, it is not necessary to additionally dispose a drive source such as a motor or the like for rotating the shutter 81 and a drive force conductive mechanism for conducting the drive force to the shutter 81. Because of this, it is possible to alleviate the number of components increasing and the structure becoming complicated. Besides, it is also possible to alleviate the cost increase.

Besides, in the present embodiment, as described above, the manual paper-sheet feed portion 106 includes the swing shaft 82 that is disposed in parallel with the shaft direction of the rotary shaft of the paper-sheet feed roller 61 at the position higher than the contact position where the paper-sheet feed roller 61 and the paper sheet P come into contact with each other. And the shutter 81 includes, at the one end portion, the fit-in portion 81*a* into which the swing shaft 82 is fitted, the fit-in portion 81*a* is rotatably fitted into the swing shaft 82, whereby the shutter is supported rotatably in the A direction and the B direction. According to this structure, it is possible to easily swing the shutter 81 in the A direction and the B direction.

Besides, in the present embodiment, as described above, the manual paper-sheet feed portion 106 includes the lift plate 74 that is disposed at the paper-sheet feeding opening 130P of the manual tray 71. The lift plate 74 is supported in an ascendable and descendible manner with the upstream-side portion in the paper-sheet feed direction used as the pivot, and ascends to lift and make the tip end portion of the paper sheet P placed on the manual tray 71 come into contact with the paper-sheet feed roller 61. And, both end portions of the shutter 81 are each provided with the contact portion 81*b* that extends downward beyond the upper end position of the end portion 74*a* of the lift plate 74 near the paper-sheet feeding opening 130P when the lift plate 74 descends to the lower limit position. According to this structure, when the lift plate 74 ascends from the lower limit position, the shutter 81 neither swing in the B direction nor come onto the lift plate 74. In other words, a disadvantage, in which the shutter 81 blocks the end portion 74*a* of the lift plate 74 to discourage the ascent of the lift plate 74, does not occur.

Besides, in the present embodiment, as described above, the end portion 74*a* of the lift plate 74 near the paper-sheet feeding opening 130P is provided with the cutout 74*b* (first cutout portion) that avoids the interference with the contact portion 81*b* of the shutter 81. According to this structure, the contact portion 81*b* of the shutter 81 does not become an obstacle when the lift plate 74 ascends.

Besides, in the present embodiment, as described above, the paper-sheet feeding opening 130P is provided with the wall-like stopper 78 (wall portion) for positioning the tip end of the paper sheet P placed on the manual tray 71 in the downstream side in the paper-sheet feed direction with respect to the contact portion 81*b* of the shutter 81. And, the stopper 78 is provided with the cutout 78*a* (second cutout portion) that avoids the interference with the contact portion 81*b* of the shutter 81 when the shutter 81 swings in the A direction. According to this structure, even if the shutter 81 is provided with the contact portion 81*b*, the contact portion 81*b* of the shutter 81 does not come into contact with the stopper 78. In other words, it is possible to swing the shutter 81 in the A direction.

It should be considered that the embodiment disclosed this time is an example in all respects and is not limiting. The scope of the present disclosure is not indicated by the above description of the embodiment but by the claims, and all modifications within the scope of the claims and the meaning equivalent to the claims are covered.

For example, the drive force of the paper sheet-feed motor for rotating the paper-sheet feed roller 61 may be conducted to the shutter 81 as well, and the shutter 81 may be swung in the A direction by means of the drive force of the paper-sheet feeding motor. In the case where this structure is employed, although not shown, the shutter 81 is mounted on the rotary shaft and the paper-sheet feeding motor is connected to the rotary shaft via a torque limiter. Further, a stopper is disposed in the rotary route of the shutter 81 in the A direction. The disposition position of the stopper is the rotary position of the shutter 81 in the A direction when the paper-sheet feeding opening 130P is opened.

In this way, when the paper-sheet feeding motor rotates, the paper-sheet feed roller 61 rotates in the A direction to start the paper-sheet feeding, and the shutter 81 swings in the A direction ton open the paper-sheet feeding opening 130P. In other words, the paper sheet P is fed to the manual conveyance path 130 via the paper-sheet feeding opening 130P. And, when the shutter 81 swings somewhat in the A direction, the shutter 81 comes into contact with the stopper to stop the rotation in the A direction. During this period, thanks to a function of the torque limiter, the drive force of the paper-sheet feeding motor is not conducted to the rotary shaft of the shutter 81. Accordingly, an unnecessary load is not exerted on the drive mechanism that includes the paper-sheet feeding motor. In the meantime, to return the shutter 81 to the position so as to shield the paper-sheet feeding opening 130P by rotating the shutter 81 in the B direction, for example, a clutch is shut off to make the shutter 81 swings in the B direction by means of its weight.

Or, by additionally disposing a motor dedicated to the rotation of the shutter 81 and rotating the dedicated motor forward and backward, the shutter 81 may be swung in the A direction and the B direction. In this case, the torque limiter and the clutch become unnecessary. Besides, if a stepping motor is used as a motor dedicated to the rotation of the shutter 81, it is possible to detect the rotary position of the shutter 81 without disposing a position detection sensor for detecting the rotary position of the shutter 81.

What is claimed is:

1. An image forming apparatus including a manual feed portion that is disposed on a side surface of an apparatus main body and feeds a recording medium placed manually to a conveyance path of the apparatus main body, the manual feed portion including:

a manual tray that is mounted on the apparatus main body in an openable and closable manner and allows, in an opened state, to load the recording medium thereon;

a feed opening that is exposed in the opened state of the manual tray to accept feeding of the recording medium from the manual tray to the conveyance path;

a feed roller that is disposed at the feed opening, comes into contact with the recording medium placed on the manual tray from above the recording medium, rotates in one direction in the contact state with the recoding medium and thereby feeds the recording medium to the conveyance path via the feed opening; and a shutter that is disposed so as to shield the feed opening, wherein:

the shutter is disposed on both sides in a shaft direction of a rotary shaft of the feed roller, one end portion of the shutter is disposed above the manual tray, the shutter is rotatably supported along a feed direction with the one end portion used as a pivot; at a shielding position so as to shield the feed opening, when the feeding of the recording medium to the conveyance path is started by the feed roller, the shutter swings toward a downstream side in the feed direction to open the feed opening; when an upstream-side end portion, in the feed direction, of the recording medium passes through the feed opening, the shutter swings toward the upstream side in the feed direction to return to the shielding position;

the manual feed portion includes a lift plate that is disposed at the feed opening side of the manual tray;

the lift plate is supported so as to be movable up and down with an upstream-side portion of the lift plate in the feed direction used as a pivot, and lifts a downstream-side portion, in the feed direction, of the recording medium placed on the manual tray to make the downstream-side portion of the recording medium come into contact with the feed roller;

the shutter is provided with a contact portion that extends downward beyond a downstream-side end portion of the lift plate in the feed direction when the lift plate descends to a predetermined lower limit position; and the downstream-side end portion of the lift plate in the feed direction is provided with a first cutout portion that avoids interference with the contact portion when the lift plate is moving up and down.

2. The image forming apparatus according to claim 1, wherein at the shielding position, the shutter is disposed to oppose a downstream-side end portion, in the feed direction, of the recording medium; when the feeding of the recording medium to the conveyance path is started by the feed roller, the shutter comes into contact with the downstream-side end portion, in the feed direction, of the recording medium to be pushed and thereby swings toward the downstream side in the feed direction to open the feed opening; when the contact between the shutter and the upstream-side end portion, in the feed direction, of the recording medium is released, the shutter swings, by means of its weight, toward the upstream side in the feed direction to return to the shielding position.

3. The image forming apparatus according to claim 2, wherein the manual feed portion includes a swing shaft that is disposed in parallel with the shaft direction of the rotary shaft of the feed roller at a position higher than a contact position where the feed roller and the recording medium come into contact with each other; and the shutter includes, at the one end portion, a fit-in portion into which the shaft is fitted, the fit-in portion is rotatably fitted into the shaft, whereby the shutter is rotatably supported along the feed direction.

4. The image forming apparatus according to claim 1, wherein when the shutter swings from the shielding position toward the upstream side in the feed direction, the first cutout portion of the lift plate comes into contact with the contact portion of the shutter to limit the rotation of the shutter toward the upstream side in the feed direction.

5. The image forming apparatus according to claim 1, wherein the manual feed portion includes a wall portion for positioning the downstream-side end portion of the recording medium placed on the manual tray in the feed direction disposed in the downstream side of the shutter in the feed direction;

a part of the feed opening is formed above the wall portion;

the shutter includes a shield portion that shields the feed opening above the wall portion; and the wall portion is provided with a second cutout portion that avoids interference with the contact portion of the shutter when the shutter swings toward the downstream side in the feed direction.

6. An image forming apparatus including a manual feed portion that is disposed on a side surface of an apparatus main body and feeds a recording medium placed manually to a conveyance path of the apparatus main body, the manual feed portion including:

a manual tray that is mounted on the apparatus main body in an openable and closable manner and allows, in an opened state, to load the recording medium thereon;

a feed opening that is exposed in the opened state of the manual tray to accept feeding of the recording medium from the manual tray to the conveyance path;

a feed roller that is disposed at the feed opening, comes into contact with the recording medium placed on the manual tray from above the recording medium, rotates in one direction in the contact state with the recoding medium and thereby feeds the recording medium to the conveyance path via the feed opening; and a shutter that is disposed so as to shield the feed opening, wherein:

the shutter is disposed on both sides in a shaft direction of a rotary shaft of the feed roller, one end portion of the shutter is disposed above the manual tray, the shutter is rotatably supported along a feed direction with the one end portion used as a pivot; at a shielding position so as to shield the feed opening, when the feeding of the recording medium to the conveyance path is started by the feed roller, the shutter swings toward a downstream side in the feed direction to open the feed opening; when an upstream-side end portion, in the feed direction, of the recording medium passes through the feed opening, the shutter swings toward the upstream side in the feed direction to return to the shielding position;

the manual feed portion includes a lift plate that is disposed at the feed opening side of the manual tray;

the lift plate is supported in an ascendable and descendible manner with an upstream-side portion of the lift plate in the feed direction used as a pivot, and lifts a downstream-side portion, in the feed direction, of the recording medium placed on the manual tray to make the downstream-side portion come into contact with the feed roller;

the shutter includes a shield portion that shields the feed opening; and the shield portion allows the lift plate to ascend and descend between: a lower limit position of the lift plate where the recording medium is supplied to the manual tray; and a contact position where the recording medium comes into contact with the feed roller.

* * * * *